US011232897B2

(12) United States Patent
Kitatani et al.

(10) Patent No.: US 11,232,897 B2
(45) Date of Patent: Jan. 25, 2022

(54) WINDING PART

(71) Applicant: TDK Corporation, Tokyo (JP)

(72) Inventors: Kazuharu Kitatani, Tokyo (JP); Kiyomi Yamazaki, Tokyo (JP); Tomokazu Ikarashi, Tokyo (JP)

(73) Assignee: TDK Corporation, Tokyo (JP)

( * ) Notice: Subject to any disclaimer, the term of this patent is extended or adjusted under 35 U.S.C. 154(b) by 658 days.

(21) Appl. No.: 16/136,578

(22) Filed: Sep. 20, 2018

(65) Prior Publication Data

US 2019/0164688 A1 May 30, 2019

(30) Foreign Application Priority Data

Nov. 24, 2017 (JP) ..... JP2017-225360

(51) Int. Cl.

| | |
|---|---|
| ***H01F 27/32*** | (2006.01) |
| ***H01F 27/29*** | (2006.01) |
| ***H01F 27/24*** | (2006.01) |
| ***H01F 27/30*** | (2006.01) |

(52) U.S. Cl.

CPC ..... *H01F 27/325* (2013.01); *H01F 27/24* (2013.01); *H01F 27/29* (2013.01); *H01F 27/292* (2013.01); *H01F 27/30* (2013.01)

(58) Field of Classification Search

CPC ..... H01F 27/325; H01F 2027/297

See application file for complete search history.

(56) References Cited

U.S. PATENT DOCUMENTS

| | | | | |
|---|---|---|---|---|
| 5,696,477 | A | 12/1997 | Yamamori et al. | |
| 6,525,637 | B1 * | 2/2003 | Van Gestel | H01F 27/325 336/192 |
| 6,559,749 | B1 | 5/2003 | Weiner | |
| 8,269,593 | B2 | 9/2012 | Tsai et al. | |
| 8,570,768 | B2 * | 10/2013 | Quek | H05K 7/02 361/836 |
| 9,837,194 | B1 * | 12/2017 | Folker | H01F 27/40 |
| 2005/0275498 | A1 * | 12/2005 | Haga | H01F 41/076 336/208 |

(Continued)

FOREIGN PATENT DOCUMENTS

| | | |
|---|---|---|
| CN | 202749209 U | 2/2013 |
| CN | 109841395 A | 6/2019 |

(Continued)

OTHER PUBLICATIONS

Chinese Office Action issued in corresponding Chinese Application No. 201811131240.X, dated Sep. 21, 2020 (6 pages).

(Continued)

*Primary Examiner* — Elvin G Enad
*Assistant Examiner* — Malcolm Barnes
(74) *Attorney, Agent, or Firm* — Flynn Thiel, P.C.

(57) ABSTRACT

First terminals connected to a first winding and second terminals connected to a second winding that is required to be insulated from the first winding are protruded from a bobbin, at least two terminals for each winding. The terminals are sequentially disposed in a row as "a first terminal, a first terminal, a second terminal, and a second terminal" in that order. A winding part is provided, of which mounting area can be reduced even when an automatic winding machine winds a plurality of windings at a time.

4 Claims, 4 Drawing Sheets

(56) References Cited

U.S. PATENT DOCUMENTS

| | | | | |
|---|---|---|---|---|
| 2006/0244561 | A1 | 11/2006 | Iwakura et al. | |
| 2007/0126542 | A1 | 6/2007 | He et al. | |
| 2011/0037554 | A1* | 2/2011 | Tsai | H01F 27/306 336/196 |
| 2011/0043315 | A1* | 2/2011 | Kobayashi | H01F 27/29 336/192 |
| 2011/0193673 | A1* | 8/2011 | Tsai | H01F 27/325 336/84 M |
| 2011/0199176 | A1 | 8/2011 | Tada | |
| 2012/0223799 | A1* | 9/2012 | Hester | H01F 27/30 336/220 |
| 2013/0169400 | A1 | 7/2013 | Kim et al. | |
| 2014/0266540 | A1* | 9/2014 | Yang | H01F 27/2866 336/192 |
| 2015/0116068 | A1* | 4/2015 | Kwon | H01F 27/2828 336/192 |
| 2015/0137928 | A1 | 5/2015 | Wakibayashi et al. | |
| 2019/0164687 | A1 | 5/2019 | Kitatani et al. | |

FOREIGN PATENT DOCUMENTS

| | | | | |
|---|---|---|---|---|
| JP | 61196512 | U | | 12/1986 |
| JP | 62125610 | A | | 6/1987 |
| JP | 63228705 | A | * | 9/1988 |
| JP | 63228705 | A | | 9/1988 |
| JP | 476023 | U | | 7/1992 |
| JP | 669051 | A | | 3/1994 |
| JP | 06069051 | A | * | 3/1994 |
| JP | 864435 | A | | 3/1996 |
| JP | 8-306550 | A | | 11/1996 |
| JP | 3184261 | U | * | 6/2013 |
| JP | 3184261 | U | | 6/2013 |
| JP | 2019096750 | A | | 6/2019 |
| TW | 201128665 | A1 | | 8/2011 |

OTHER PUBLICATIONS

Chinese Office Action issued in corresponding Chinese Application No. 201811131240.X dated May 18, 2021 (7 pages).

Notice of Reasons for Refusal issued in corresponding Japanese Patent Application No. 2017-225360, with English translation, dated Jul. 2, 2021 (12 pages).

* cited by examiner

FIG. 2A
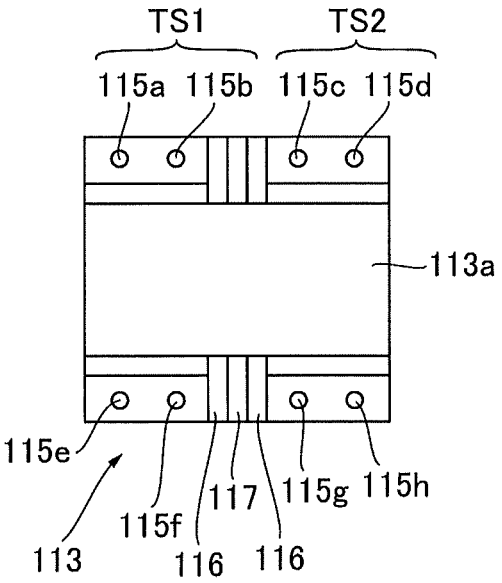
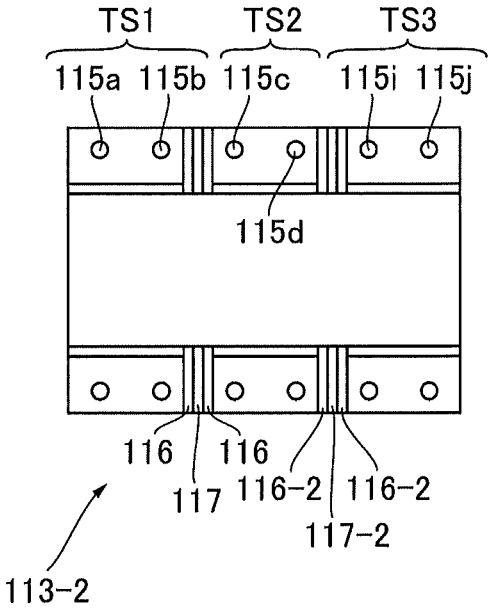
FIG. 2B
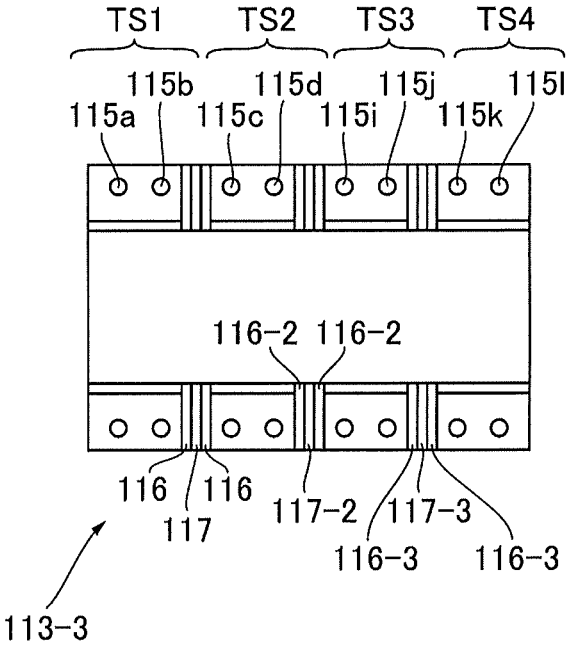
FIG. 2C

WINDING PART

CROSS-REFERENCE TO RELATED APPLICATION

This application claims priority to Japanese Patent Application No. 2017-225360 filed Nov. 24, 2017 which is hereby expressly incorporated by reference herein in its entirety.

BACKGROUND OF THE INVENTION

1. Field of the Invention

The present invention relates to winding parts, and more particularly, to a winding part on which a plurality of windings is wound at the same time.

2. Description of the Related Art

Conventionally known is a winding part/component having a winding structure (e.g., Bifilar winding) for winding a plurality of windings on a bobbin at the same time (see FIG. 3(a) of Japanese Patent Application Laid-Open No. Hei. 8-306550). Here, with four conductors extended downwardly from the bobbin, two adjacent conductors 2, 3 on the left (the symbols as used in Japanese Patent Application Laid-Open No. Hei. 8-306550) are the start of windings and the two adjacent conductors 2, 3 on the right are the end of the windings.

However, concerning the winding part disclosed in Japanese Patent Application Laid-Open No. Hei. 8-306550, when an automatic winding machine winds a plurality of windings on a bobbin at a time, it is required to ensure the insulation distance between the terminals provided on the bobbin (the terminal-to-terminal distance between the terminals connected to the winding start conductors or between the terminals connected to the winding end conductors). However, when an attempt is to be made to ensure the insulation distance, the separation between each nozzle and the next one through which the windings are drawn out of the automatic winding machine limits the terminal-to-terminal distance. Thus, an insulation distance is required between adjacent terminals to each of which different windings are connected, so that an insulation portion needs to be provided between the terminals. This leads to an increase in the size of the structure of the winding part itself.

SUMMARY OF THE INVENTION

In this context, the present invention has been developed to address the problems mentioned above. It is therefore an object of the invention to provide a winding part which requires a reduced mounting area even when an automatic winding machine winds a plurality of windings at a time.

To solve the aforementioned problems, the present invention provides a winding part including a bobbin, a first winding, at least two first terminals connected to the first winding, a second winding that is required to be insulated from the first winding, and at least two second terminals connected to the second winding, the at least two first terminals and the at least two second terminals being protruded from the bobbin, and the terminal arrangements of the terminals are configured such that they are sequentially arranged in a row in the following order: "a first terminal, a first terminal, a second terminal, and a second terminal."

An automatic winding machine, which has a predetermined fixed positional relation of nozzles (an interval between each nozzle and the next one), winds a plurality of windings at the same time while keeping the positional relation. Advantage is taken of this property to arrange the terminals as described above. This makes it possible to constitute a winding part having a reduced mounting area while leaving the distance between each nozzle and the next one of the automatic winding machine unchanged. That is, the first terminals connected to the first winding and the second terminals connected to the second winding are disposed in a row sequentially in the order mentioned above. This minimizes the terminal-to-terminal distances between the first terminals to which connected is the same winding (the first winding) or between the second terminals to which connected is the same winding (the second winding). It is thus possible to reduce the size of the winding part itself. That is, for example, the terminal-to-terminal distance between "the first terminal connected to the first winding corresponding to the start of winding" and "the second terminal connected to the second winding corresponding to the start of winding" and the terminal-to-terminal distance between "the first terminal connected to the first winding corresponding to the end of winding" and "the second terminal connected to the second winding corresponding to the end of winding" can be each designed to be reduced. As a result, it is possible to constitute a winding part having a reduced mounting area. In other words, according to the arrangement described above, two adjacent terminals may not have to be used as those corresponding to the start of winding (or the end of winding), so that another terminal is always placed between terminals that are associated with nozzles of the automatic winding machine. Furthermore, insulation portions between terminals to which different windings are connected are arranged so that the interval therebetween is reduced as compared with the conventional terminal arrangement. This makes it possible to reduce the size of the winding part itself, thereby contributing to the reduction of the mounting area.

Furthermore, in the winding part according to the present invention described above, when the two first terminals in the terminal arrangement are collectively defined as a first terminal set and the two second terminals are collectively defined as a second terminal set, the bobbin is provided with an insulation portion configured to ensure an insulation distance between the first terminal set and the second terminal set.

According to this configuration, the insulation portion is provided between the first terminal set and the second terminal set, that is, between the first terminal connected to the first winding and the second terminal connected to the second winding. Since this configuration enables ensuring a sufficient insulation distance (a creepage distance and/or a spatial distance), it is possible to design a reduced distance between both the terminal sets, with the result of constituting a winding part having a reduced mounting area.

Furthermore, the winding part according to the present invention described above includes, in addition to the first terminals connected to the first winding and the second terminals connected to the second winding, windings up to nth windings that are each required to be insulated from the first winding and the second winding, and terminals up to nth terminals to be connected respectively to all windings up to the nth windings, where the terminals are protruded, at least two terminals for each winding, and the windings included in up to the nth one are required to be insulated from each other. These terminals are sequentially arranged, subsequent to the terminal arrangement as set forth above, in a row in the following order: " . . . , the (n−2)th terminal, the (n−2)th terminal, the (n−1)th terminal, the (n−1)th terminal, the nth terminal, and the nth terminal."

As described above, even in some cases where windings up to the nth one, such as the third winding, the fourth winding, . . . and so on, may be wound at the same time, the present invention is applicable in the same manner.

Application of the present invention enables provision of a winding part which requires only a reduced mounting area even when an automatic winding machine winds a plurality of windings at a time.

BRIEF DESCRIPTION OF THE DRAWINGS

FIGS. 2A, 2B, and 2C illustrate schematic bottom configuration diagrams of a winding part, 2A a schematic bottom configuration diagram of the winding part of the first embodiment as shown in FIGS. 1A and 1B, and 2B and 2C schematic bottom configuration diagrams illustrating other variations;

DETAILED DESCRIPTION OF THE PREFERRED EMBODIMENTS

Figure 1B:
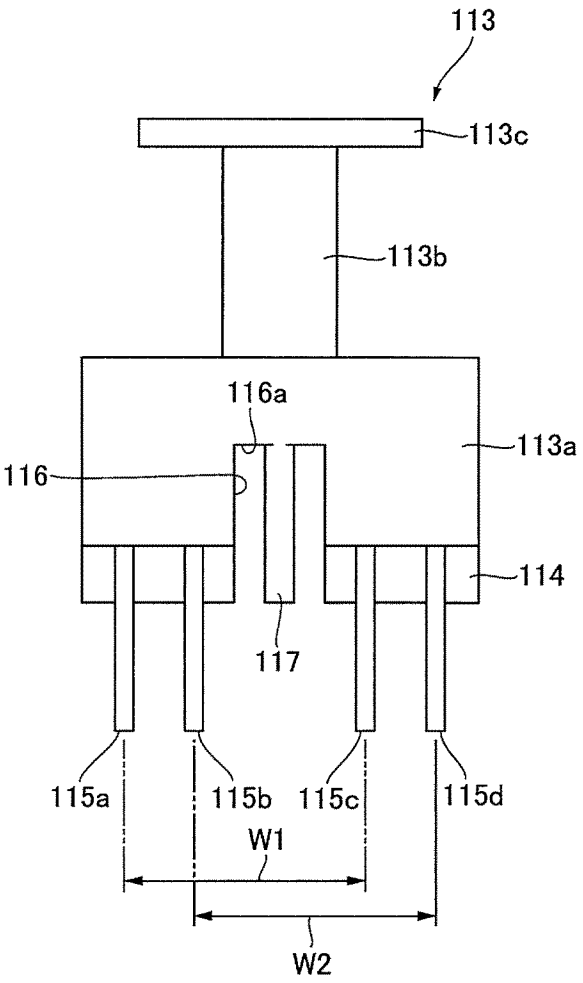
FIGS. 1A and 1B illustrate a winding part according to a first embodiment to which the present invention is applied, 1A a perspective view and 1B a side view.

With reference to the attached drawings, a description will be given of a winding part according to an embodiment according to the present invention. For the sake of ease of understanding of the drawings, the size and dimensions of each component are partly emphasized, and hence do not necessarily coincide with those of actual products at some portions. Each drawing is viewed in the orientation of reference numerals, and up and down, left and right, front and back are represented on the basis of the orientation.

[Configuration of Winding Part]

Figure 1A:
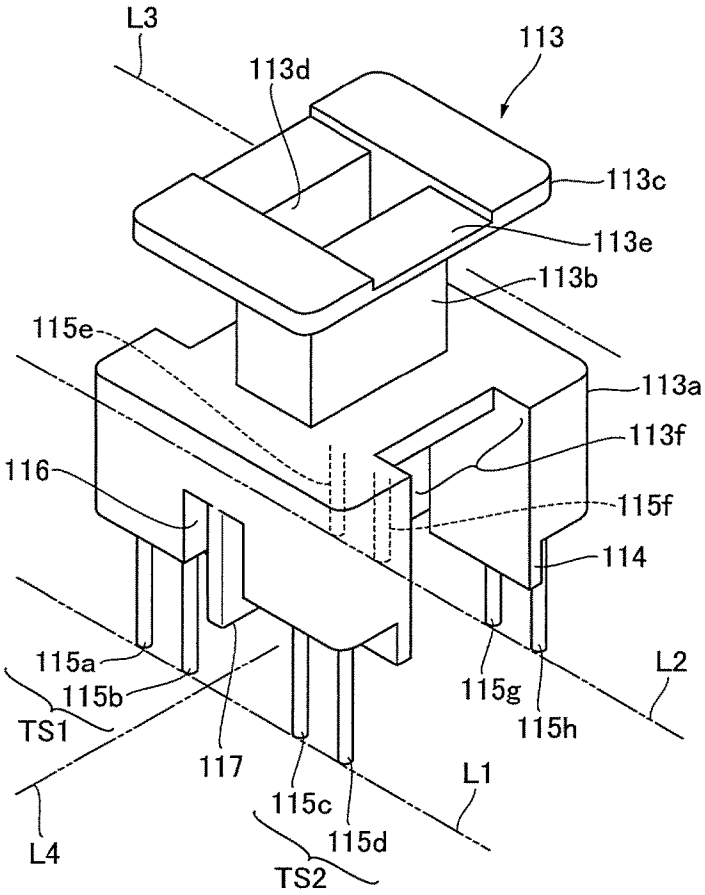

FIGS. 1A and 1B illustrate a transformer (an example of a winding part) which includes a bobbin 113, and a winding and a magnetic core (not illustrated in the figure) attached to the bobbin 113.

The bobbin 113 includes a main body 113*a* having eight terminals (115*a* to 115*h*) on the bottom; a column 113*b* which is provided on top of and generally at the center of the main body 113*a* and around which a winding (not illustrated in the figure) is wound; and a flange 113*c* which is provided on the upper end of the column 113*b*. The column 113*b* is formed in a cylindrical shape having a hollow 113*d* in the vertical direction. The magnetic core is attached so as to sandwich the column 113*b* in the vertical direction (also see FIG. 3) and is mounted in a manner such that part of the magnetic core (e.g., the center column of an E-type core) is inserted into the hollow 113*d* inside the column 113*b*. Furthermore, the magnetic core is mounted along the direction of a step height groove 113*e* provided on the flange 113*c* (a first direction or L3 direction).

The main body 113*a* is provided with a core groove 113*f* for inserting the magnetic core therein in the same direction (L3) as that of the step height groove 113*e* of the flange 113*c*. Furthermore, four terminals are provided in a straight line on each of both sides of the core groove 113*f*, and thus, eight terminals 115*a* to 115*f* in total are provided in the two rows (L1, L2) with the core groove 113*f* therebetween.

In front of the core groove 113*f* in FIG. 1A, the four terminals 115*a*, 115*b*, 115*c*, and 115*d* are disposed in a row (L1): the two terminals 115*a* and 115*b* thereof (the start of winding and the end of winding) on the left are first terminals to be connected to a first winding; and the two terminals 115*c* and 115*d* (the start of winding and the end of winding) on the right are second terminals to be connected to a second winding (the second winding being required to be insulated from the first winding). That is, the terminals are sequentially arranged in a row (L1) in the following order: "the first terminal 115*a* (one side of the first terminal), the first terminal 115*b* (the other side of the first terminal), the second terminal 115*c* (one side of the second terminal), and the second terminal 115*d* (the other side of the second terminal)."

Furthermore, in the rear of the core groove 113*f* in FIG. 1A, the four terminals 115*e*, 115*f*, 115*g*, 115*h* are disposed in a row (L2): the two terminals 115*e* and 115*f* thereof on the left are first terminals that can be connected to the first winding (the start of winding and the end of winding); and the two terminals 115*g* and 115*h* on the right are second terminals that can be connected to the second winding (the start of winding and the end of winding) (which is required to be insulated from the first winding). That is, here, the terminals are sequentially arranged in a row (L2) in the following order: "the first terminal 115*e*, the first terminal 115*f*, the second terminal 115*g*, and the second terminal 115*h*" (also see FIG. 2A).

Furthermore, when the two first terminals 115*a* and 115*b* disposed along L1 are collectively defined as a first terminal set TS1 and the two second terminals 115*c* and 115*d* are collectively defined as a second terminal set TS2, the main body 113*a* of the bobbin 113 is provided with a recess (insulation portion) 116 between the first terminal set TS1 and the second terminal set TS2 in a direction L4 different from L1 (L2, L3) (a second direction: in this embodiment, a direction generally orthogonal to L1, L2, and L3). The recess 116 is formed so as to be opened toward the bottom of the bobbin 113 (so as to be recessed upward from the bottom), that is, in a manner such that a groove is placed upside down. Furthermore, the recess 116 is provided with a plate-shaped insulating plate (insulation portion) 117 vertically from a recess bottom 116*a* along the direction L4 that is the same as that of the recess 116. Note that the length of the insulating plate 117 extends generally to the same position as that of the lower end of a skirt 114 that is brought into contact with the surface of a substrate (not illustrated in the figure) when the bobbin 113 is placed on the substrate. When the bobbin 113 is mounted on the substrate, the lower end of the insulating plate 117 is brought into contact with the substrate.

Furthermore, as illustrated in FIG. 1B, each terminal is disposed in a manner such that the terminal-to-terminal distance W1 between the first terminal 115*a* (one side of the first terminal) and the second terminal 115*c* (one side of the second terminal) and the terminal-to-terminal distance W2 between the first terminal 115*b* (the other side of the first terminal) and the second terminal 115*d* (the other side of the second terminal) are the same as each other. This enables the automatic winding machine to wind a plurality of (two in this embodiment) windings at the same time. That is, when the first terminal 115*a* is selected as the start terminal of winding the first winding, the second terminal 115*c* is selected as the start terminal of winding the second winding. At the same time, the first terminal 115*b* is selected as the end terminal of winding the first winding and the second terminal 115*d* is selected as the end terminal of winding the second winding. That is, the automatic winding machine starts winding at the first terminal 115*a* and the second terminal 115*c* between which the terminal-to-terminal distance W1 is ensured, whereas the automatic winding machine ends winding at the first terminal 115*b* and the second terminal 115*d* between which the terminal-to-terminal distance W2 (the same as the terminal-to-terminal distance W1) is ensured. Thus, a sufficient terminal-to-terminal distance is ensured. In other words, by reducing these terminal-to-terminal distances W1 and W2 to the limit which allows the nozzles of the automatic winding machine to work, it is possible to reduce the mounting area of the bobbin 113 serving as a winding part. Note that as a matter of course, the automatic winding machine can operate when the start and end terminals of winding are reversed.

Furthermore, since the first terminal 115*a* and the first terminal 115*b* are the start of winding and the end of winding of the same winding (the first winding), respectively, the terminal-to-terminal distance therebetween may be minimized. Likewise, since the second terminal 115*c* and the second terminal 115*d* are used for the same winding (the second winding), the terminal-to-terminal distance therebetween may be minimized. Thus, the first terminal 115*a* and the first terminal 115*b*, and the second terminal 115*c* and the second terminal 115*d* can be arranged to reduce the terminal-to-terminal distance to the limit that enables the nozzles of the automatic winding machine to work. That is, as described in this embodiment, insulation means such as the recess (insulation portion) 116 or the insulating plate (insulation portion) 117 may only be provided between the first terminal 115*b* and the second terminal 115*c* to which mutually different windings are connected. It is thus possible to reduce the size of the winding part itself and thereby reduce the mounting area.

As described above, according to the present invention, the first terminals 115*a* and 115*b* connected to the first winding and the second terminals 115*c* and 115*d* connected to the second winding required to be insulated from the first winding are protruded, at least two terminals for each winding, from the bobbin 113. The terminal arrangements are configured such that they are sequentially disposed in a row (L1); "the first terminal 115*a*, the first terminal 115*b*, the second terminal 115*c*, and the second terminal 115*d*" in that order.

The automatic winding machine, which has a predetermined fixed positional relation of nozzles (an interval between the nozzles), winds a plurality of windings at the same time while keeping the positional relation. Advantage is taken of this property to arrange the terminals as described above. This makes it possible to constitute a winding part having a reduced mounting area while leaving the distance between the nozzles of the automatic winding machine unchanged. That is, the first terminals 115*a* and 115*b* connected to the first winding and the second terminals 115*c* and 115*d* connected to the second winding are disposed in a row sequentially in that order. This minimizes the terminal-to-terminal distances between the first terminals connected to the same winding (the first winding) or between the second terminals connected to the same winding (the second winding). It is thus possible to reduce the size of the winding part. That is, for example, the terminal-to-terminal distance W1 between "the first terminal 115*a* connected to the first winding corresponding to the start of winding" and "the second terminal 115*c* connected to the second winding corresponding to the start of winding" and the terminal-to-terminal distance W2 between "the first terminal 115*b* connected to the first winding corresponding to the end of winding" and "the second terminal 115*d* connected to the second winding corresponding to the end of winding" can be each designed to be reduced. As a result, it is possible to constitute a winding part having a reduced mounting area.

Furthermore, in the aforementioned terminal arrangement, when the two first terminals 115*a* and 115*b* are collectively defined as the first terminal set TS1 and the two second terminals 115*c* and 115*d* are collectively defined as the second terminal set TS2, the bobbin 113 is provided with the recess 116 and the insulating plate 117 configured to ensure an insulation distance (a creepage distance and/or a spatial distance) between the first terminal set TS1 and the second terminal set TS2.

This configuration enables to ensure a sufficient insulation distance (the creepage distance and/or the spatial distance) between the first terminal set TS1 and the second terminal set TS2, that is, between the first terminals 115*a*, 115*b* connected to the first winding and the second terminals 115*c*, 115*d* connected to the second winding. It is thus possible to design a reduced distance between both the terminal sets TS1, TS2, with the result of constituting a winding part having a reduced mounting area.

Note that the automatic winding machine may be used not always to wind two windings at the same time but also to wind three or more windings at the same time, and even in such a case, the present invention is also applicable. For example, as shown in FIG. 2B by way of example, in addition to the first terminals 115*a* and 115*b* connected to the first winding and the second terminals 115*c* and 115*d* connected to the second winding, third terminals 115*i* and 115*j* connected to all the windings up to the third one that are required to be each insulated from the first winding and the second winding are also protruded, at least two terminals for each winding. These terminals are sequentially arranged in a row in the following order: "the first terminal 115*a*, the first terminal 115*b*, the second terminal 115*c*, the second terminal 115*d*, the third terminal 115*i*, and the third terminal 115*j*." This arrangement also provides the same effects even in the case of three windings. Furthermore, when the two first terminals 115*a* and 115*b* are collectively defined as the first terminal set TS1, the two the second terminals 115*c* and 115*d* are collectively defined as the second terminal set TS2, and the two third terminals 115*i* and 115*j* are collectively defined as a third terminal set TS3, a recess (116, 116-2) and an insulating plate 117, 117-2 may be provided between each of the terminal sets. This makes it possible to ensure a sufficient insulation distance (the creepage distance and/or the spatial distance) between each terminal set and the next. It is thus possible to design a reduced distance between both terminal sets, with the result of constituting a winding part having a further reduced mounting area.

Furthermore, for example, as shown in FIG. 2(*c*) by way of example, in addition to the first terminals 115*a* and 115*b* connected to the first winding and the second terminals 115*c* and 115*d* connected to the second winding, the third terminals 115*i* and 115*j* and fourth terminals 115*k* and 115*l* connected to all the windings up to the fourth one that are required to be insulated from the first winding and the second winding are also protruded, at least two terminals for each winding. These terminals are sequentially arranged in a row in the following order: "the first terminal 115*a*, the first terminal 115*b*, the second terminal 115*c*, the second terminal 115*d*, the third terminal 115*i*, the third terminal 115*j*, the fourth terminal 115*k*, and the fourth terminal 115*l*." This arrangement also provides the same effects even in the case of four windings. Furthermore, when the two first terminals 115*a* and 115*b* are collectively defined as the first terminal set TS1, the two the second terminals 115*c* and 115*d* are collectively defined as the second terminal set TS2, the two third terminals 115*i* and 115*j* are collectively defined as the third terminal set TS3, and the two fourth terminals 115*k* and 115*l* are collectively defined as a fourth terminal set TS4, there may be provided a recess (116, 116-2, 116-3) and an insulating plate 117, 117-2, 117-3 between each of the terminal sets. This makes it possible to ensure a sufficient insulation distance (the creepage distance and/or the spatial distance) between each terminal set and the next. It is thus possible to design a reduced distance between both the terminal sets, with the result of constituting a winding part having a reduced mounting area.

As described above, in some cases where windings up to the nth one, as the third winding, the fourth winding, . . . and so on, may be wound at the same time, the present invention is applicable in the same manner. That is, for windings up to the nth one, the terminals are sequentially arranged in a row in the following order: " . . . , the (n−2)th terminal, the (n−2)th terminal, the (n−1)th terminal, the (n−1)th terminal, the nth terminal, and the nth terminal". As described with reference to the embodiments, the insulation portion such as the recess 116 and the insulating plate 117 is preferably provided, for example, between the (n−2)th terminal and the (n−1)th terminal and between the (n−1)th terminal and the nth terminal, which are required to be insulated from each other.

[Another Example Configuration]

Figure 3B:
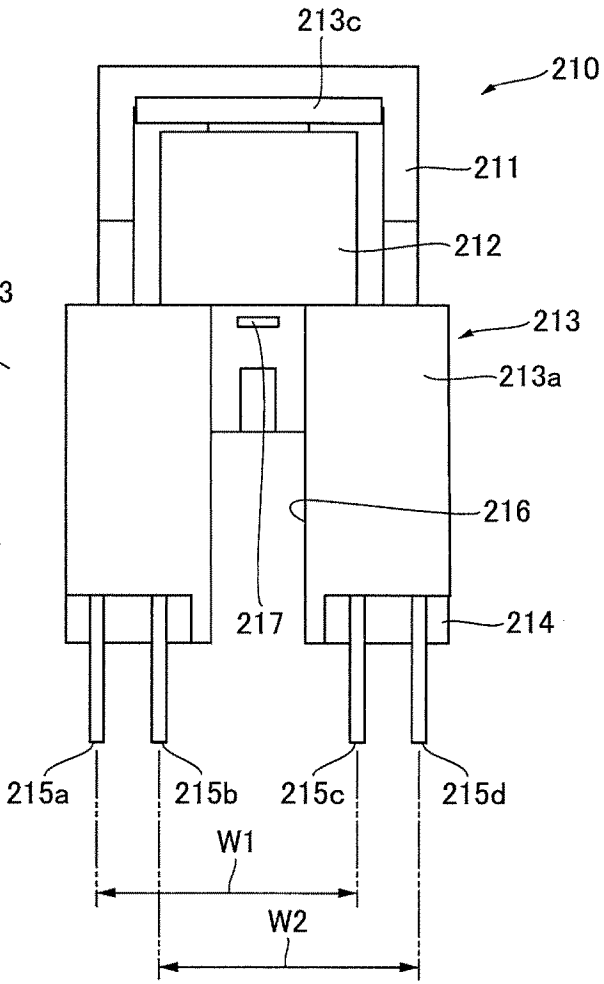
FIGS. 3A and 3B illustrate a winding part according to a second embodiment to which the present invention is applied, 3A a perspective view and 3B a side view.
Figure 3A:
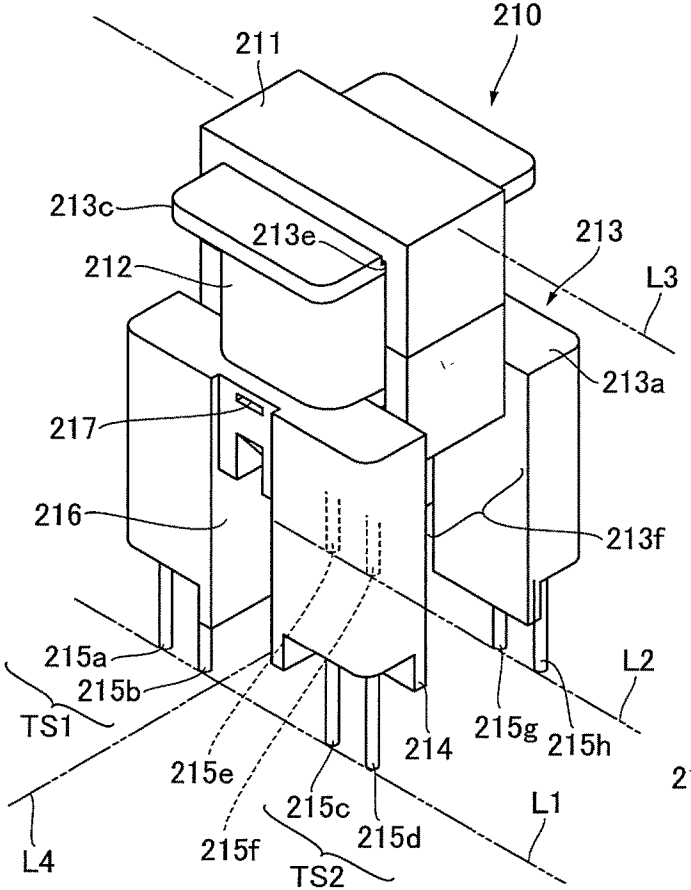

FIGS. 3A and 3B illustrate another example configuration of "the insulation portion" that is disposed between the terminal sets TS1 and TS2. In FIGS. 3A and 3B, by way of example, a winding part is constructed as a transformer 210 in which a bobbin 213 is provided with a winding 212 and a magnetic core 211.

The bobbin 213 includes a main body 213*a* having eight terminals on the bottom; a column (not illustrated) which is provided generally at the center of the main body 213*a* and on which the winding 212 is wound; and a flange 213*c* provided on the upper end of the column. The column on which the winding 212 is wound is formed in a cylindrical shape having a hollow portion in the vertical direction. The magnetic core 211 is attached to sandwich the column in the vertical direction, and is mounted so that part of the magnetic core 211 (e.g., the center column of an E-type core) is inserted into the hollow inside the column. Furthermore, the magnetic core 211 is mounted along the direction of a step height groove 213*e* provided on the flange 213*c* (the first direction: the L3 direction).

The main body 213*a* is provided with a core groove 213*f* for inserting the magnetic core 211 therein in the same direction (L3) as that of the step height groove 213*e* of the flange 213*c*. Furthermore, four terminals are provided in a straight line on each of both sides of the core groove 213*f*, and thus, eight terminals in total are provided in the two rows (L1, L2) with the core groove 213*f* therebetween.

In front of the core groove 213*f* in FIG. 3A, the four terminals 215*a*, 215*b*, 215*c*, and 215*d* are disposed in a row (L1): the two terminals 215*a* and 215*b* thereof (the start of winding and the end of winding) on the left are first terminals to be connected to a first winding; and the two terminals 215*c* and 215*d* (the start of winding and the end of winding) on the right are second terminals to be connected to a second winding (required to be insulated from the first winding). That is, the terminals are sequentially arranged in a row (L1) in the following order: "the first terminal 215*a*, the first terminal 215*b*, the second terminal 215*c*, and the second terminal 215*d*."

Furthermore, in the rear of the core groove 213*f* in FIG. 3A, the four terminals (the first terminal 215*e*, the first terminal 215*f*, the second terminal 215*g*, and the second terminal 215*h*) are disposed in a row (L2) in the same manner as mentioned above.

Furthermore, when the two first terminals 215*a* and 215*b* disposed along L1 are collectively defined as the first terminal set TS1 and the two second terminals 215*c* and 215*d* are collectively defined as the second terminal set TS2, the main body 213*a* of the bobbin 213 is provided with a recess (insulation portion) 216 in the direction L4 different from L1 (also L2, L3) (a second direction: in this embodiment, a direction generally orthogonal to L1, L2, and L3) between the first terminal set TS1 and the second terminal set TS2. The recess 216 is formed so as to be opened toward the bottom of the bobbin 213 (so as to be recessed upward from the bottom), that is, in a manner such that a groove is placed upside down. The recess 216 ensures the creepage distance between the first terminal set TS1 and the second terminal set TS2. Furthermore, for example, a locking part 217 may be combined with another plate-shaped member (not illustrated in the figure) that reaches at least the substrate surface on which the transformer 210 is mounted. A projection provided on this another member (insulation member) is engaged with the locking part 217, thereby ensuring a spatial distance without causing the another member to be dislodged therefrom.

Furthermore, as illustrated in FIG. 3B, each terminal is disposed so that the terminal-to-terminal distance W1 between the first terminal 215*a* and the second terminal 215*c* and the terminal-to-terminal distance W2 between the first terminal 215*b* and the second terminal 215*d* are the same as each other. This enables the automatic winding machine to wind a plurality of (two in this embodiment) windings at the same time. That is, when the first terminal 215*a* is selected as the start terminal of winding the first winding, the second terminal 215*c* is selected as the start terminal of winding the second winding, and at the same time, the first terminal 215*b* is selected as the end terminal of winding the first winding and the second terminal 215*d* as the end terminal of winding the second winding. That is, the automatic winding machine starts winding as the first terminal 215*a* and the second terminal 215*c* between which the terminal-to-terminal distance W1 is ensured, and the automatic winding machine ends winding at the first terminal 215*b* and the second terminal 215*d* between which the terminal-to-terminal distance W2 is ensured. Thus, a sufficient terminal-to-terminal distance is ensured. In other words, these terminal-to-terminal distances W1, W2 can be reduced to the minimum that allows the nozzles of the automatic winding machine to work, thereby reducing the mounting area of the bobbin 213 serving as a winding part. Note that as a matter of course, the automatic winding machine can operate even when the terminals for the start of winding and the end of winding are interchanged.

Figure 4B:
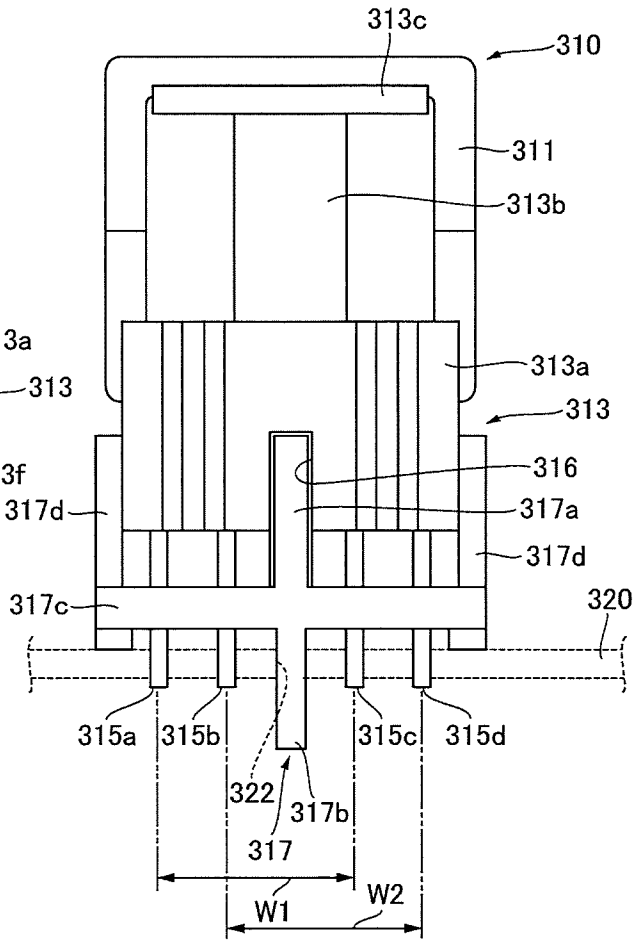
FIGS. 4A and 4B illustrate a winding part according to a third embodiment to which the present invention is applied, 4A a perspective view and 4B a side view.
Figure 4A:
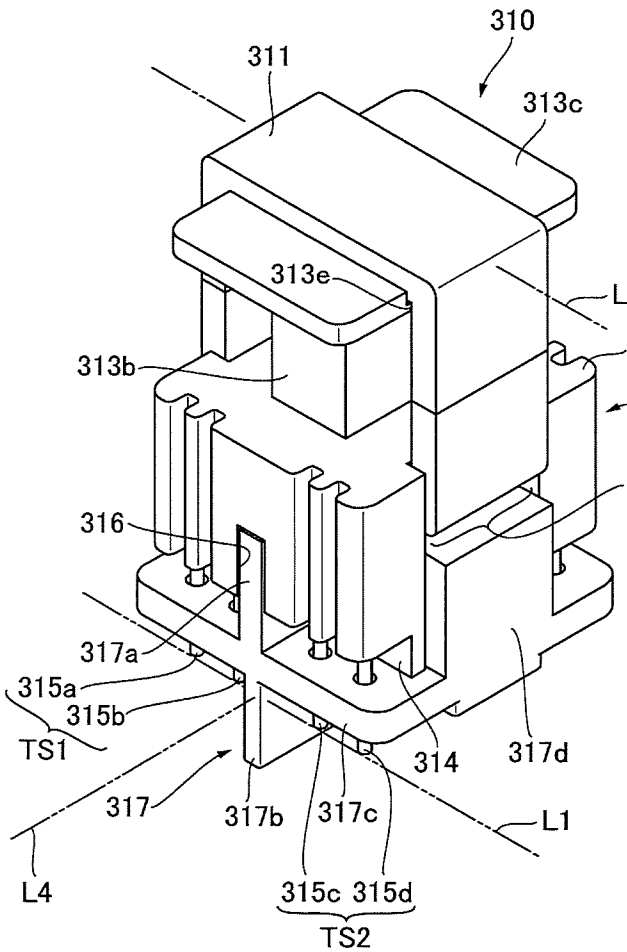

FIGS. 4A and 4B illustrate still another example configuration of "the insulation portion" to be disposed between each terminal set TS1, TS2 and the next. In FIGS. 4A and 4B, by way of example of a winding part, a magnetic core 311 is attached to a bobbin 313, thus being formed as a transformer 310.

The bobbin 313 includes a main body 313*a* having eight terminals on the bottom; a column 313*b* which is provided on top of and generally at the center of the main body 313*a* and around which a winding (not illustrated in the figure) is wound; and a flange 313*c* which is provided on the upper end of the column 313*b*. The column 313*b* on which a winding is wound is formed in a cylindrical shape having a hollow in the vertical direction. The magnetic core 311 is attached so as to sandwich the column 313*b* in the vertical direction, and is mounted in a manner such that part of the magnetic core 311 (e.g., the center column of an E-type core) is inserted into the hollow inside the column 313*b*. Furthermore, the magnetic core 311 is mounted along the direction of a step height groove 313*e* provided on the flange 313*c* (the first direction: the L3 direction).

The main body 313*a* is provided with a core groove 313*f* for inserting the magnetic core 311 therein in the same direction (L3) as that of the step height groove 313*e* of the flange 313*c*. Furthermore, four terminals are provided in a straight line on each of both sides of the core groove 313*f*, and thus, eight terminals in total (some terminals not illustrated in the drawing) are provided in the two rows (L1, L2) with the core groove 313*f* therebetween.

In front of the core groove 313*f* in FIG. 4A, four terminals 315*a*, 315*b*, 315*c*, and 315*d* are disposed in a row (L1): the two terminals 315*a* and 315*b* thereof (the start of winding and the end of winding) on the left are first terminals to be connected to a first winding; and the two terminals 315*c* and 315*d* (the start of winding and the end of winding) on the right are second terminals to be connected to a second winding (which is required to be insulated from the first winding). That is, the terminals are sequentially arranged in a row (L1) in the following order: "the first terminal 315*a*, the first terminal 315*b*, the second terminal 315*c*, and the second terminal 315*d*."

Furthermore, in the rear of the core groove 313*f* in FIG. 4, the four terminals are disposed in a row (L2) in the same manner as mentioned above.

Furthermore, when the two first terminals 315*a* and 315*b* disposed along L1 are collectively defined as a first terminal set TS1 and the two second terminals 315*c* and 315*d* are collectively defined as a second terminal set TS2, the main body 313*a* of the bobbin 313 is provided with a recess (insulation portion) 316 between the first terminal set TS1 and the second terminal set TS2 in a direction L4 different from L1 (L2, L3) (a second direction: in this embodiment, a direction generally orthogonal to L1, L2, and L3). The recess 316 is formed so as to be opened toward the bottom of the bobbin 313 (so as to be recessed upward from the bottom), that is, in a manner such that a groove is placed upside down. Furthermore, the recess 316 is provided with an insulation plate (insulation portion) 317 as an additional member to be inserted therein. The insulation plate 317 employs a horizontal plate 317*c* as a base that is formed to have generally the same size as the bottom area of the main body 313*a* of the bobbin 313: on the upper side thereof are provided an upper wall 317*a* capable of being fitted into the recess 316 and an upper block 317*d* capable of being fitted into the core groove 313*f*; and on the lower side is provided a lower wall 317*b* that is generally the same size as that of the upper wall 317*a*. The horizontal plate 317*c* is provided with terminal holes into each of which each of eight terminals can be inserted, allowing each terminal to be attached to each terminal hole so as to be inserted therein. Furthermore, both surfaces of the upper wall 317*a* or both surfaces of the upper block 317*d* are provided with a locking part (locking projection) and the recess 316 or the core groove 313*f* is provided with a locking part (locking recess) formed therein. The locking parts (locking projection and locking recess) are engaged with each other, thereby addressing problems, e.g., preventing the insulation plate 317 from being unintendedly dislodged from the bobbin 313. Note that as illustrated in FIG. 4B, the lower wall 317*b* is disposed to be fitted into a slit 322 which is provided on a substrate 320 on which the transformer 310 is mounted.

According to such a configuration, the insulation distance (the creepage distance and/or the spatial distance) between the first terminal set TS1 and the second terminal set TS2 is ensured on the upper side of the substrate 320 (placement surface side). At the same time, the insulation distance (the creepage distance and/or the spatial distance) between the first terminal set TS1 and the second terminal set TS2 is also ensured on the lower side (soldering surface) of the substrate 320.

Furthermore, as illustrated in FIG. 4B, each terminal is disposed in a manner such that the terminal-to-terminal distance W1 between the first terminal 315*a* and the second terminal 315*c* and the terminal-to-terminal distance W2 between the first terminal 315*b* and the second terminal 315*d* are the same as each other. This enables the automatic winding machine to wind a plurality of (two in this embodiment) windings at the same time. That is, when the first terminal 315*a* is selected as the start terminal of winding the first winding, the second terminal 315*c* is selected as the start terminal of winding the second winding, and at the same time, the first terminal 315*b* is selected as the end terminal of winding the first winding and the second terminal 315*d* as the end terminal of winding the second winding. That is, the automatic winding machine starts winding at the first terminal 315*a* and the second terminal 315*c* between which the terminal-to-terminal distance W1 is ensured, whereas the automatic winding machine ends winding at the first terminal 315*b* and the second terminal 315*d* between which the terminal-to-terminal distance W2 is ensured. Thus, a sufficient terminal-to-terminal distance is ensured. In other words, by reducing these terminal-to-terminal distances W1 and W2 to the limit which allows the nozzles of the automatic winding machine to work, it is possible to reduce the mounting area of the bobbin 313 serving as a winding part. Note that as a matter of course, the automatic winding machine can operate when the start and end terminals of winding are reversed.

What is claimed is:

1. A winding part comprising:

a bobbin;

a first winding;

at least two first terminals connected to the first winding;

a second winding that is required to be insulated from the first winding; and at least two second terminals connected to the second winding, the at least two first terminals and the at least two second terminals being protruded from the bobbin;

wherein terminal arrangements of these terminals are configured such that the terminals are sequentially arranged in a row in the following order: "a first terminal, a first terminal, a second terminal, and a second terminal";

wherein the at least two first terminals in the terminal arrangements are collectively defined as a first terminal set and the at least two second terminals are collectively defined as a second terminal set, and the bobbin is provided with an insulation portion configured to ensure an insulation distance between the first terminal set and the second terminal set; and wherein the insulation portion includes:

a recess which is formed so as to be recessed upward from a bottom of the bobbin; and an insulating plate which protrudes integrally from a bottom of the recess along a same direction as the recess, the insulating plate further protruding above the bottom of the bobbin and intervening between the first terminal set and the second terminal set.

2. The winding part according to claim 1, comprising, in addition to the first terminals connected to the first winding and the second terminals connected to the second winding, windings up to nth windings that are each insulated from the first winding and the second winding, and terminals up to nth terminals to be connected respectively to all windings up to the nth windings, wherein the terminals are protruded, at least two terminals for each winding, and the windings included in up to the nth one are insulated from each other, and the terminals are sequentially arranged in a row in the following order: " . . . , the (n−2)th terminal, the (n−2)th terminal, the (n−1)th terminal, the (n−1)th terminal, the nth terminal, and the nth terminal".

3. A winding part comprising:

a bobbin;

a first winding;

at least two first terminals connected to the first winding;

a second winding that is insulated from the first winding; and at least two second terminals connected to the second winding, the at least two first terminals and the at least two second terminals being protruded from the bobbin;

wherein the at least two first terminals and the at least two second terminals are sequentially arranged in a row with the at least two first terminals being arranged in the row sequentially before the at least two second terminals;

wherein the at least two first terminals in the terminal arrangements are collectively defined as a first terminal set and the at least two second terminals are collectively defined as a second terminal set, and the bobbin includes an insulation portion ensuring an insulation distance between the first terminal set and the second terminal set; and wherein the insulation portion includes:

a recess formed upward from a bottom of the bobbin; and an insulating plate which protrudes integrally from a bottom of the recess along a same direction as the recess, the insulating plate further protruding above the bottom of the bobbin and intervening between the first terminal set and the second terminal set.

4. The winding part according to claim 3, comprising, in addition to the first terminals connected to the first winding and the second terminals connected to the second winding, windings up to nth windings that are each insulated from the first winding and the second winding, and terminals up to nth terminals connected respectively to all windings up to the nth windings, wherein the terminals are protruded, at least two terminals for each winding, and the windings included in up to the nth one are insulated from each other, and the terminals are sequentially arranged in a row in the following order: at least two first terminals, the at least two second terminals, . . . , the (n−2)th terminal, the (n−2)th terminal, the (n−1)th terminal, the (n−1)th terminal, the nth terminal, and the nth terminal.

* * * * *